US008833913B2

(12) United States Patent
Satoh et al.

(10) Patent No.: US 8,833,913 B2
(45) Date of Patent: Sep. 16, 2014

(54) LIQUID CONTAINER AND IMAGE FORMING APPARATUS

(71) Applicants: Mitsuru Satoh, Tokyo (JP); Tomonori Tamura, Kanagawa (JP); Motoyuki Anno, Shiga (JP)

(72) Inventors: Mitsuru Satoh, Tokyo (JP); Tomonori Tamura, Kanagawa (JP); Motoyuki Anno, Shiga (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/024,837

(22) Filed: Sep. 12, 2013

(65) Prior Publication Data

US 2014/0078226 A1 Mar. 20, 2014

(30) Foreign Application Priority Data

Sep. 18, 2012 (JP) ..... 2012-203858

(51) Int. Cl.
*B41J 2/175* (2006.01)

(52) U.S. Cl.
USPC ..... 347/86

(58) Field of Classification Search
USPC ..... 347/84–87
See application file for complete search history.

(56) References Cited

U.S. PATENT DOCUMENTS

| | | | | |
|---|---|---|---|---|
| 5,157,421 | A * | 10/1992 | Kitahara | 347/86 |
| 6,830,322 | B2 * | 12/2004 | Shihoh et al. | 347/86 |
| 7,040,743 | B2 * | 5/2006 | Acosta et al. | 347/86 |
| 7,934,821 | B2 * | 5/2011 | Hattori | 347/86 |

FOREIGN PATENT DOCUMENTS

| | | |
|---|---|---|
| JP | 56-131169 | 10/1981 |
| JP | 11-348317 | 12/1999 |
| JP | 3342372 | 11/2002 |
| JP | 2013-169684 | 9/2013 |

OTHER PUBLICATIONS

U.S. Appl. No. 13/859,303, filed Apr. 9, 2013.
U.S. Appl. No. 13/746,639, filed Jan. 22, 2013 (corresponding to JP2013-169684).

* cited by examiner

*Primary Examiner* — Kristal Feggins
(74) *Attorney, Agent, or Firm* — Cooper & Dunham LLP

(57) ABSTRACT

A liquid cartridge includes an ink bag for storing liquid and being capable of changing its shape, a housing for storing the ink bag, a guiding tube member for being placed in the ink bag, and a liquid supply outlet for providing the liquid to outside the ink bag and being connected to an end of the guiding tube member. Another end of the guiding tube member is placed close to or touching a bottom of the ink bag. The liquid cartridge further includes a bottom plate for supporting the bottom of the ink bag. The bottom plate is configured to be moved with respect to the housing. As remaining ink in the ink bag decreases, the bottom plate is moved to be in an inclining state by an inclination adding member that is placed in a cartridge installing unit of an apparatus.

4 Claims, 5 Drawing Sheets

LIQUID CONTAINER AND IMAGE FORMING APPARATUS

BACKGROUND OF THE INVENTION

1. Field of the Invention

The disclosures herein generally relate to a liquid container and an image forming apparatus.

2. Description of the Related Art

Image forming apparatuses using a liquid jetting recording method, such as printers, fax machines, copy machines, plotters, multifunction machines, printing machines, etc., that use a recording head including a liquid jetting head (liquid drop jetting head) are known.

As one of these image forming apparatuses, an image forming apparatus is known that, in order to support multi-hour continuous printing, includes a liquid cartridge that is a large capacity liquid container. Such a liquid cartridge is replaceable and is capable of being installed in the main body of the apparatus.

Conventionally, a large capacity liquid cartridge of this kind includes a flexible sealed-structure recording liquid container in which liquid is stored and a guiding tube for guiding recording liquid to outside the container, which includes a plurality of holes on its surrounding surface and is capable of being installed in the recording liquid container (Patent Document 1).

Also, there is a large capacity liquid cartridge that is capable of, by including an ink guiding tube inside of an ink bag for containing ink for guiding ink to outside the ink bag, and by having the thickness of the ink bag near the end of the ink guiding tube thicker than other parts of the ink bag, causing the ink bag to deform at the parts further away from the ink guiding tube (Patent Document 2).

[Patent Document 1] Japanese Patent Application Publication No. 56-131169

[Patent Document 2] Japanese Patent No. 3342372

SUMMARY OF THE INVENTION

In the meantime, in the large capacity liquid cartridge described above, a liquid supply outlet should be placed in the upper part of the cartridge because if the liquid supply outlet is placed in the lower part of the cartridge, a lot of liquid will go out in the case where something wrong occurs in the liquid supply outlet.

Therefore, in the configuration disclosed in the Patent Document 1, in addition to a problem that the ink guiding tube becomes long, there is a problem that a liquid amount becomes large that remains unconsumed inside of the cartridge because it is difficult to place the ink guiding tube snaking through all areas of the recording liquid container.

Also, in the configuration disclosed in the Patent Document 2, there is a problem similar to the above in that a liquid amount becomes large that remains unconsumed inside of the cartridge because it is difficult to cause the ink bag to deform uniformly due to the complicated shape around the edge line that exists inside of the ink bag.

It is a general object of at least one embodiment of the present invention to reduce the unconsumed remaining liquid amount as much as possible in order to obviate one or more problems described above.

In one embodiment, in order to solve the above problems, a liquid container according to the present invention is a liquid container for containing liquid that is provided in a main body of an image forming apparatus, the liquid container including a liquid containing member of a flexible shape configured to contain the liquid, a housing that includes the liquid containing member, an guiding tube member placed inside of the liquid containing member, and a liquid supply outlet configured to be connected to one end of the guiding tube member and to supply the liquid to outside the liquid containing member. The other end of the guiding tube member is placed close to or touching the bottom surface of the liquid containing member, a supporting member that supports the bottom of the liquid containing member is further included, the supporting member is configured in such a way that it can be moved with respect to the housing, and the supporting member is moved to an inclining state by an inclination adding unit of a liquid container storing unit of the main body of the apparatus.

According to the present invention, it becomes possible to reduce an amount of unconsumed remaining liquid as much as possible.

BRIEF DESCRIPTION OF THE DRAWINGS

Other objects and further features of embodiments will become apparent from the following detailed description when read in conjunction with the accompanying drawings.

DESCRIPTION OF THE PREFERRED EMBODIMENTS

Figure 1:
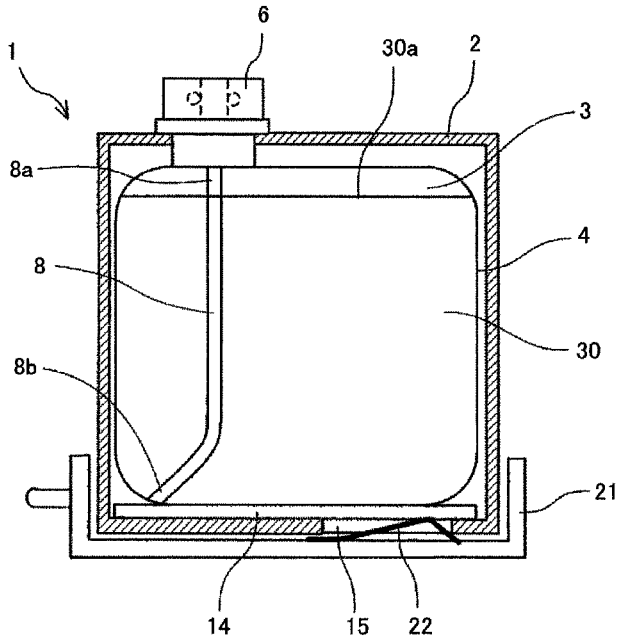
FIG. 1 is a cross section schematic diagram illustrating a liquid cartridge as a liquid container according a first embodiment of the present invention, together with a cartridge storing unit of a main body of an apparatus.

In the following, embodiments of the present invention will be described with reference to the accompanying drawings. The first embodiment of the present invention will be described referring to FIG. 1 and FIG. 2. FIG. 1 is the cross section schematic diagram illustrating a liquid cartridge 1 as a liquid container according the first embodiment of the present invention, together with the cartridge storing unit of the main body of the apparatus.

Figure 2:
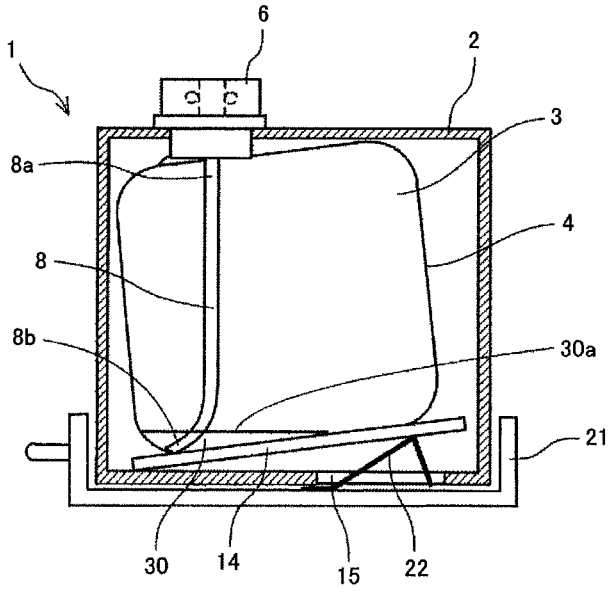
FIG. 2 is a cross section schematic diagram illustrating an ink bag of the liquid cartridge caused to be moved to an inclining state in the first embodiment.

FIG. 2 is the cross section schematic diagram illustrating an ink bag 4 of the liquid cartridge 1 caused to be moved to the inclining state in the first embodiment.

The liquid cartridge 1 as a liquid container includes a housing 2 that constitutes an outer wall; the ink bag 4 that is included inside of the housing 2, and is a liquid containing member forming a liquid container 3, and further is capable of changing shape; a guiding tube member 8 placed in the ink bag 4; and a liquid supply outlet 6 connected to one end of the guiding tube member 8.

Figure 3:
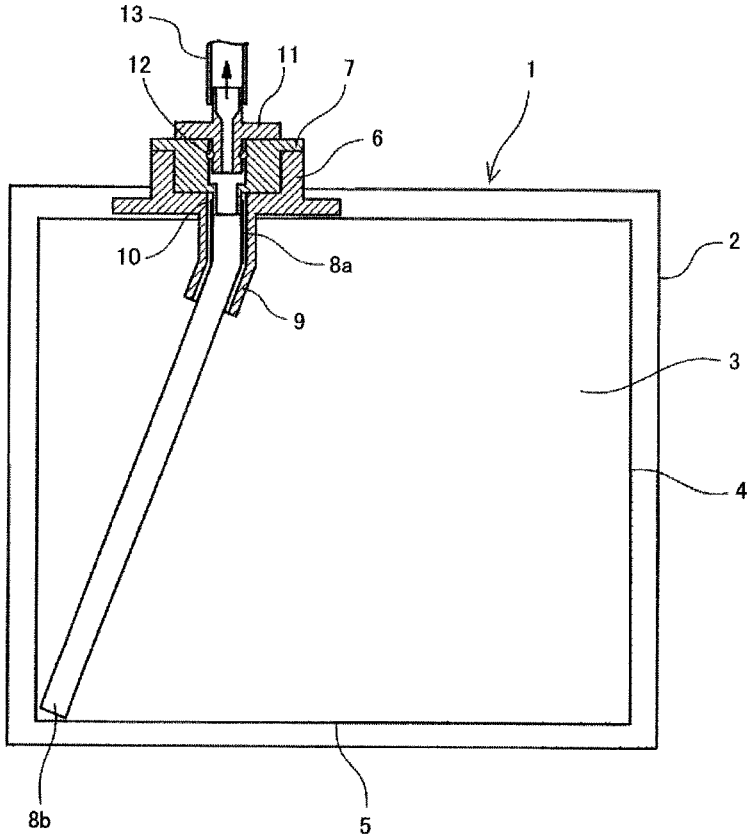
FIG. 3 is a cross section schematic diagram illustrating the ink bag.
Figure 4:
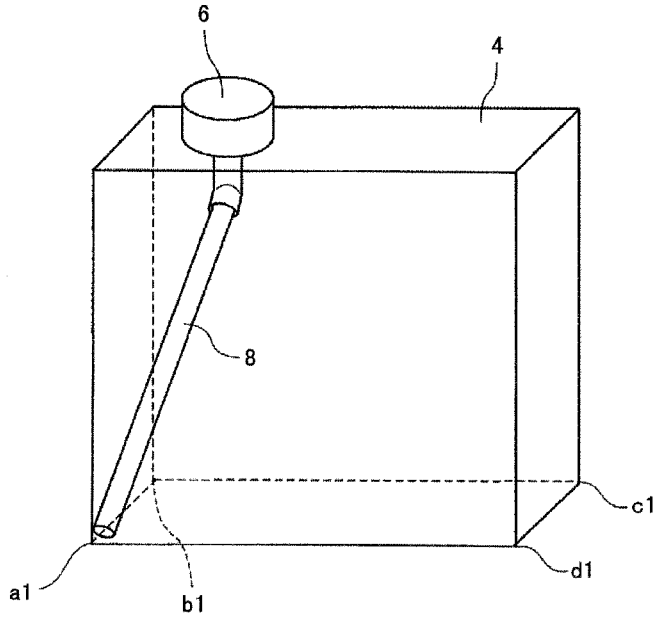
FIG. 4 is a perspective view illustrating the ink bag.
Figure 5:
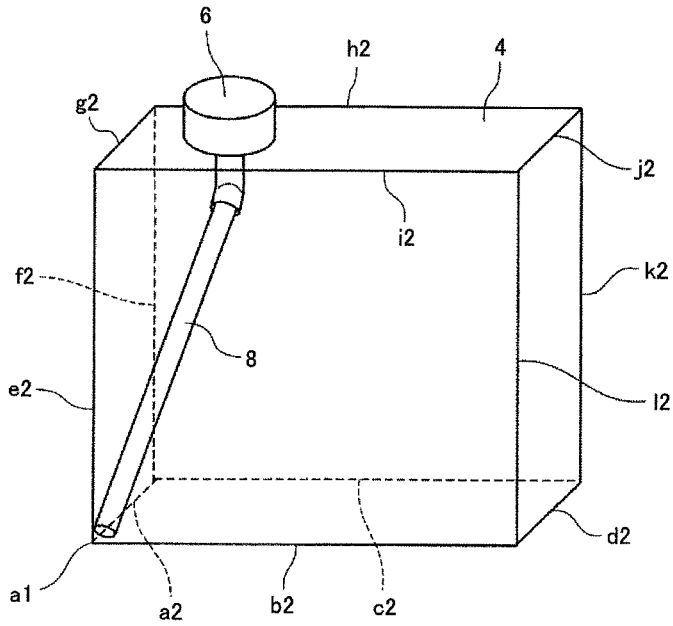
FIG. 5 is a perspective view illustrating the ink bag.

Here, the ink bag 4 will be described referring to FIG. 3 through FIG. 5. FIG. 3 is a cross section schematic diagram illustrating the ink bag 4. FIG. 4 is the perspective view illustrating the ink bag 4. FIG. 5 is the perspective view illustrating the ink bag 4.

The ink bag 4 is, as illustrated in FIG. 3 through FIG. 5, approximately of a shape of a cuboid consisting of 6 flat surfaces, and includes 4 corners a1, b1, c1 and d1 at each of which at least 3 flat surfaces intersect in an internal wall of a bottom surface 5.

In this ink bag 4, as described above, a liquid supply outlet (liquid eject opening) 6 is included in the upper part, and one end 8*a* of the guiding tube member 8 is connected to the liquid supply outlet 6 through a supply connector 7.

This guiding tube member 8 is immersed in the liquid in the ink bag 4, is used for pulling up ink, is made of elastic resin tube, and is as strong at maintaining a shape as a pipe when guiding ink. Regarding the connection between the guiding tube member 8 and the supply connector 7, adhesive material may be used, but it is preferable to use a mating connection in order to increase the number of choices for types of ink to be contained.

Also, regarding the liquid supply outlet 6, a guiding unit 9 for restricting the direction of the guiding tube member 8 in the ink bag is included, which guiding unit 9 is integrated with the liquid supply outlet 6 (or may not be integrated with the liquid supply outlet 6). By this guiding unit 9, a guiding opening unit 8*b*, which is the other end of the guiding tube member 8, is restricted in its direction so as to be pressed to (touching) the corner a1 that exists in the internal wall of the ink bag 4 as shown in FIG. 4.

Note that regarding the location to which the guiding opening unit 8*b* of the guiding tube member 8 restricted by the guiding unit 9 is pressed, it is not limited to the corner a1, but may be any of the other corners b1, c1 or d1.

Also, although the guiding opening unit 8*b* of the guiding tube member 8 is caused to be touching a corner of the ink bag 4 in this case, the guiding tube member 8 may be placed, for example, in a hanging configuration by including a weight at the side of the other end of the guiding tube member 8 (the side of the guiding opening unit 8*b*).

In this configuration, normally, the guiding opening unit 8*b* of the guiding tube member 8 is touching the bottom surface 5 but not touching a corner that exists in the internal wall of the bottom surface 5. But when the bottom surface 5 of the ink bag 4 is inclined, as will be described later, by having the weight at the side of the other end of the guiding tube member 8 moved, the guiding opening unit 8*b* of the guiding tube member 8 is caused to be touching the corner that exists in the internal wall of the bottom surface 5.

Attached to the supply connector 7 is, in addition to a guiding tube connection opening 10 for connecting the end unit 8*a* of the guiding tube member 8 that is described above, an o ring 12 for connecting a main body connection opening 11 that provides the main body of the image forming apparatus, which is not shown, with ink. Note that regarding the main body connection opening 11 of the main body of the apparatus, a pumping opening for pumping ink is included and a guiding tube 13 for supplying ink is connected.

Then, ink in the ink bag 4 of the liquid cartridge 1 is pumped by a pumping means such as a pump, etc., that is provided outside of the guiding tube 13. By having the pumping means operated, an ink flow route is formed from the guiding tube member 8, to a guiding tube connection opening 10, to the pumping opening, and to the guiding tube 13, so that ink is guided from the liquid cartridge 1 and is supplied to the main body of the apparatus.

Here, by having ink in the ink bag 4 of the liquid cartridge 1 guided to outside the ink bag 4, the ink bag 4 gradually shrinks while changing its form. At this time, as shown in FIG. 5, because the ink bag 4 changes its form preferentially from a part with less stiffness, ink remains in the vicinity of edge lines a2 through 12 of the ink bag 4.

In this case, the guiding opening 8*b* of the guiding tube member 8 is facing the corner a1 of the internal wall of the ink bag 4. Furthermore, the corner a1 of the ink bag 4 includes the intersection of the edge lines a2, b2 and e2, and remaining ink is collected at the corner a1. By this, the ink can be efficiently pumped and the remaining ink will drastically decrease.

Returning to FIG. 1, between the bottom of the housing 2 and the bottom surface 5 of the ink bag 4, a bottom plate 14 as a supporting member that supports the bottom surface 5 of the ink bag 4 is configured in such a way that it is capable of being inclined. Furthermore, in the bottom of the housing 2, an opening 15 is provided in the side opposite to a side to which the guiding opening unit 8*b* of the guiding tube member 8 in the ink bag 4 is facing. By this, a configuration is provided in which the bottom plate 14 can be caused to be inclined with respect to the housing 2 through use of the opening 15 of the housing 2.

In the meantime, an inclination adding member 22 is placed on the bottom surface of a cartridge storing unit 21 of the main body of the apparatus, the cartridge storing unit 21 serving as a liquid container storing unit in which the liquid cartridge 1 is installed exchangeably, the place of the inclination adding member 22 corresponding to the opening 15 of the housing 2 of the liquid cartridge 1.

Regarding the inclination adding member 22, a plate spring is used in the present embodiment. The inclination adding member 22, when the liquid cartridge 1 is installed in the cartridge storing unit 21, goes into the inside of the housing 2 through the opening 15 of the liquid cartridge 1, and touches the bottom plate 14.

As a result of this configuration, when sufficient amount of ink 30 is included in the liquid storing unit 3 in the ink bag 4 in a state where the liquid cartridge 1 is installed in the cartridge storing unit 21 (it is assumed that the ink fills the ink bag 4 to a liquid surface 30*a*), the inclination adding member 22 is in the compressed state because the weight of the ink bag 4 is applied via the bottom plate 14. At this time, the ink bag 4 stands upright as shown in FIG. 1.

Then, as the ink 30 in the ink bag 4 is consumed by printing operations, the remaining amount of the ink 30 decreases and the weight of the ink bag 4 also decreases. As a result, the force applied to the inclination adding member 22 decreases and a side of the bottom plate 14 opposite to a side to which the guiding opening 8*b* of the guiding tube member 8 is facing is moved up by a reactive spring force of the inclination adding member 22.

By this, the bottom surface 5 of the ink bag 4 is inclined, the ink 30 in the ink bag 4 is collected to the side to which the guiding opening 8*b* of the guiding tube member 8 is facing as shown in FIG. 2, every last drop of ink can be pumped via the guiding tube member 8, the remaining ink becomes very little, and the waste of the ink can be reduced.

Figure 6:
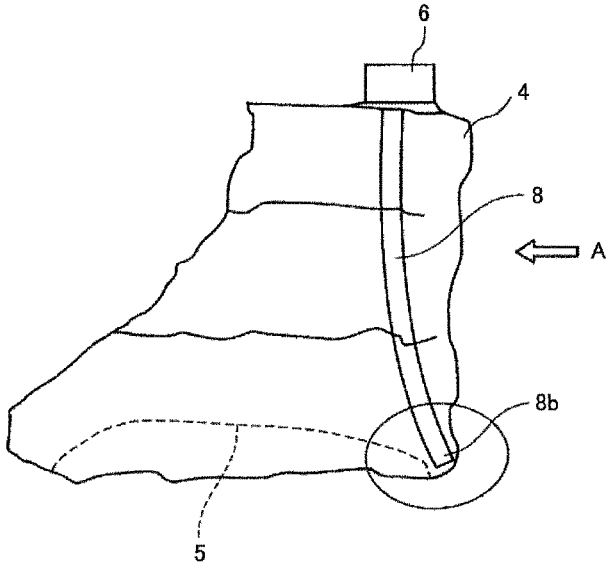
FIG. 6 is a sectional side view of a corner illustrating a shape change in accordance with the decreasing of remaining ink in the ink bag.
Figure 7:
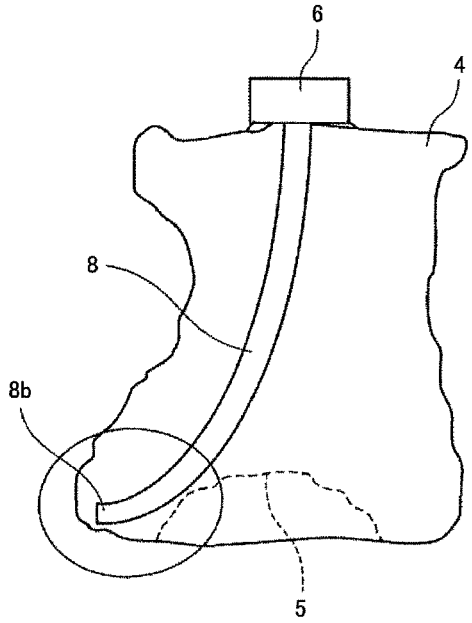
FIG. 7 is a sectional front view viewed from the direction of an arrow A in FIG. 6.

Here, the change of the form of the ink bag 4 in accordance with the decrease of the remaining ink will be described referring to FIG. 6 and FIG. 7. FIG. 6 is a sectional side view of a corner illustrating the shape change in accordance with the decrease of remaining ink in the ink bag 4. FIG. 7 is a sectional front view viewed from the direction of an arrow A in FIG. 6.

Because the ink bag 4 is capable of changing its form, as described above, by having the ink in the ink bag 4 pumped by, for example, an aspiration pump, and by reverse pressure, the volume of the liquid storing unit 3 decreases and the ink bag 4 shrinks as the remaining ink amount decreases.

At this point, as described above, the edge lines (corners) of the ink bag 4 are of high stiffness, and these edge lines of the ink bag 4 do not change their form. As shown in dotted lines in FIG. 6 and FIG. 7, the ink bag 4 changes its form in such a way that the center of the bottom surface 5 assumes a convex shape. As a result, channels are formed at the edge lines of the ink bag 4.

Here, as described above, by causing the ink bag 4 to incline so that the guiding opening 8*b* of the guiding tube member 8 is at the lower side, the channels formed at the edge lines become flowing routes of ink, the remaining ink is collected steadily at the guiding opening 8*b* of the guiding tube member 8, and the ink is pumped via the guiding tube member 8.

By this, as described above, an amount of unused remaining ink in the liquid cartridge 1 can be reduced substantially.

Figure 8:
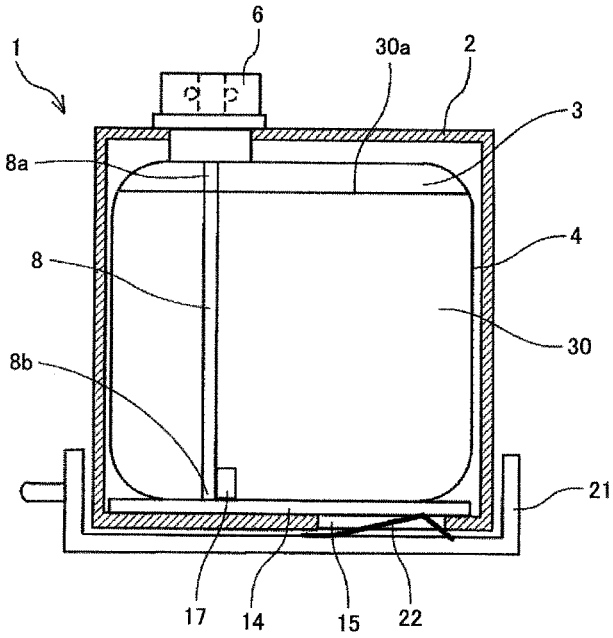
FIG. 8 is a cross section schematic diagram illustrating a liquid cartridge as a liquid container according to a second embodiment of the present invention, together with a cartridge storing unit of a main body of an apparatus.
Figure 9:
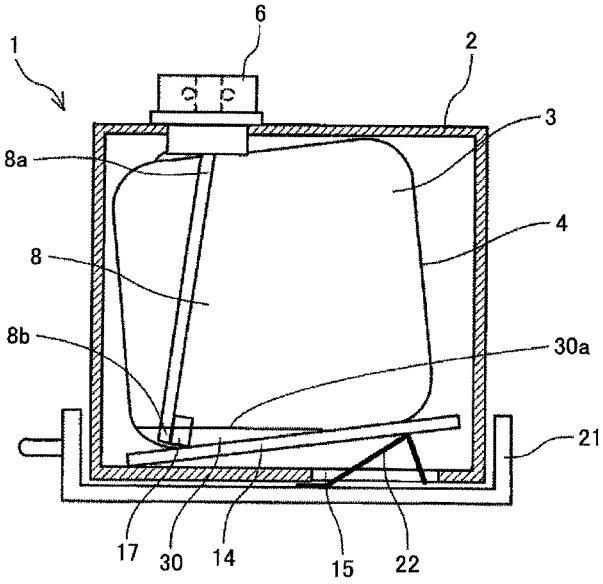
FIG. 9 is a cross section schematic diagram illustrating an ink bag of the liquid cartridge caused to be moved to an inclining state in the second embodiment.

Next, a second embodiment of the present invention will be described referring to FIG. 8 and FIG. 9. FIG. 8 is a cross section schematic diagram illustrating a liquid cartridge as a liquid container according to the second embodiment of the present invention, together with a cartridge storing unit of the main body of the apparatus. FIG. 9 is a cross section schematic diagram illustrating the ink bag of the liquid cartridge caused to be moved to an inclining state in the second embodiment.

In the present embodiment, a weight 17 is included in the side of the other end (guiding opening 8*b*) of the guiding tube member 8. This guiding opening 8*b* of the guiding tube member 8 is, in a state where the ink bag 4 is in an upright state shown in FIG. 8, hanging down straight from the liquid supply outlet 6.

As it is configured in this way, as described in the first embodiment, by having the bottom plate 14 inclined, the weight 17 moves to a side of the bottom plate 14 which becomes the lower side as shown in FIG. 9. In accordance with this movement of the weight 17, the guiding opening 8*b* of the guiding tube member 8 also moves toward a place where the ink is collected.

Note that the length of the guiding tube member 8 is configured in advance to be long enough to be able to touch a corner that exists at the internal wall of the bottom surface 5.

By this, the same as in the first embodiment, every last drop of ink can be pumped, the remaining ink becomes very little, and the waste of the ink can be reduced.

Note that in the embodiments of the present invention, "paper" is not limited to a paper member, but it includes an OHP, a cloth, glass, a substrate, etc. It means a thing to which liquid such as an ink drop can adhere, and includes what is called a recording medium, a recording paper, a recording sheet, etc. Also, it is assumed that image forming, recording, printing, etc., are synonyms.

Also, an "image forming apparatus" means an apparatus that performs image forming by jetting liquid onto media such as paper, string, fiber, cloth, leather, metal, plastic, glass, wood, ceramics, etc.

Also, "image forming" is not limited to putting a meaningful image such as characters or figures onto media, but it also means putting a meaningless image such as a pattern onto media (simply putting a liquid drop onto media).

Also, "ink" is, unless otherwise defined, not limited to what is called ink, but is used as a general name for all liquid that can perform the image forming, such as what is called recording liquid, fixing liquid, or liquid, and, for example, DNA samples, resist, pattern member, resin, etc., are included.

Also, an "image" is not limited to two dimensions, but it includes an image that is put on what is formed in three dimensions, and an image that is formed in three dimensions.

Further, the present invention is not limited to these embodiments, but various variations and modifications may be made without departing from the scope of the present invention.

The present application is based on and claims the benefit of priority of Japanese Priority Application No. 2012-203858 filed on Sep. 18, 2012, with the Japanese Patent Office, the entire contents of which are hereby incorporated by reference.

What is claimed is:

1. A liquid container for containing liquid to be supplied to an image forming apparatus, the liquid container comprising:

a liquid containing member configured to store the liquid and be capable of changing a shape thereof;

a housing configured to accommodate the liquid containing member;

a guiding tube member configured to be placed in the liquid containing member;

a liquid supply outlet, to which an end of the guiding tube member is connected, configured to supply the liquid to outside the liquid containing member, wherein another end of the guiding tube member is placed close to or touching a bottom surface of the liquid containing member; and a supporting member configured to support a bottom of the liquid containing member, wherein the supporting member is configured to be movable to an inclining state with respect to the housing by an inclination adding unit of a liquid container storing unit of the apparatus.

2. The liquid container as claimed in claim 1, wherein an end of the supporting member is movable upward by the inclination adding unit.

3. The liquid container as claimed in claim 2, wherein the end of the supporting member is moved upward when remaining liquid in the liquid containing member decreases.

4. An image forming apparatus comprising:

a liquid containing member configured to store liquid and be capable of changing a shape thereof;

a housing configured to accommodate the liquid containing member;

a guiding tube member configured to be placed in the liquid containing member;

a liquid supply outlet, to which an end of the guiding tube member is connected, configured to supply the liquid to outside the liquid containing member, wherein another end of the guiding tube member is placed close to or touching a bottom surface of the liquid containing member;

a supporting member configured to support a bottom of the liquid containing member and to be movable with respect to the housing;

a liquid container storing unit in which the liquid container is installed exchangeably; and an inclination adding unit configured to cause the supporting member to be in an inclining state by moving up an end of the supporting member.

* * * * *